US007848491B2

(12) United States Patent
Bermuth et al.

(10) Patent No.: US 7,848,491 B2
(45) Date of Patent: Dec. 7, 2010

(54) LEAD SHIELDING FOR A BETATRON

(75) Inventors: Joerg Bermuth, Mainz (DE); Georg Geus, Wiesbaden (DE); Gregor Hess, Wiesbaden (DE); Urs Viehboeck, Darmstadt (DE)

(73) Assignee: Smiths Heimann GmbH, Wiesbaden (DE)

( * ) Notice: Subject to any disclaimer, the term of this patent is extended or adjusted under 35 U.S.C. 154(b) by 18 days.

(21) Appl. No.: 12/431,648

(22) Filed: Apr. 28, 2009

(65) Prior Publication Data

US 2009/0266996 A1 Oct. 29, 2009

Related U.S. Application Data

(63) Continuation of application No. PCT/EP2007/007769, filed on Sep. 6, 2007.

(30) Foreign Application Priority Data

Oct. 28, 2006 (DE) ..... 10 2006 050 952

(51) Int. Cl.
*H05H 11/00* (2006.01)

(52) U.S. Cl. ..... 378/142; 315/504

(58) Field of Classification Search ..... 378/119, 378/203, 57, 137, 141; 315/504, 501, 500
See application file for complete search history.

(56) References Cited

U.S. PATENT DOCUMENTS

| | | | | |
|---|---|---|---|---|
| 2,822,490 | A | 2/1958 | Scag | |
| 4,454,684 | A * | 6/1984 | O'Hare | 47/82 |
| 4,533,907 | A * | 8/1985 | Thatcher | 340/565 |
| 5,065,418 | A | 11/1991 | Bermbach et al. | |
| 2005/0218347 | A1 | 10/2005 | Williamson et al. | |

FOREIGN PATENT DOCUMENTS

| | | |
|---|---|---|
| DE | 23 57 126 A1 | 5/1975 |
| EP | 0 412 190 A1 | 2/1991 |
| GB | 689542 | 4/1953 |
| WO | WO 00/19450 | 4/2000 |

* cited by examiner

*Primary Examiner*—Hoon Song
(74) *Attorney, Agent, or Firm*—Muncy, Geissler, Olds & Lowe, PLLC

(57) ABSTRACT

A lead shielding for a betatron in an X-ray generator is provided that includes at least four shielding parts of which two are semi-cylindrical and provided with recesses in the envelope surfaces thereof. The semi-cylindrical shielding parts are arranged in corresponding recesses of the remaining shielding parts by means of the envelope surfaces thereof, such that the recesses in the envelope surfaces form air channels between the semi-cylindrical shielding parts and the remaining shielding parts.

6 Claims, 4 Drawing Sheets

LEAD SHIELDING FOR A BETATRON

This nonprovisional application is a continuation of International Application No. PCT/EP2007/007769, which was filed on Sep. 6, 2007, and which claims priority to German Patent Application No. DE 10 2006 050 952.8, which was filed in Germany on Oct. 28, 2006, and which are both herein incorporated by reference.

BACKGROUND OF THE INVENTION

1. Field of the Invention

The present invention relates to lead shielding with cooling air guidance for a betatron, particularly for use in an x-ray inspection system.

2. Description of the Background Art

X-ray inspection systems such as the one illustrated in FIG. 4 are used, as is well-known, in the inspection of large-volume articles such as containers and motor vehicles for illegal contents such as weapons, explosives, or contraband goods. In so doing, x-radiation is produced and directed at the article (e.g., target 50). The x-radiation attenuated by the object is measured by means of a detector (e.g., x-ray detector 52) and analyzed by an evaluation unit (e.g., evaluation unit 54). Therefore, a conclusion can be reached on the nature of the object. This type of x-ray inspection system is known, for example, from European Pat. No. EP 0 412 190 B1, which corresponds to U.S. Pat. No. 5,065,418.

Betatrons are used to generate x-radiation with the energy of more than 1 MeV needed for the inspection. These are circular accelerators in which electrons are accelerated in an orbit. The accelerated electrons are guided onto a target, where upon impacting they produce Bremsstrahlung whose spectrum depends, inter alia, on the energy of the electrons.

A betatron disclosed in Offenlegungsschrift [Unexamined German Pat. Application] No. DE 23 57 126 A1 consists of a two-part inner yoke, in which the front sides of both inner yoke parts face each other spaced apart. A magnetic field is produced in the inner yoke by means of two main field coils. An outer yoke connects the two inner yoke part ends distant from one another and closes the magnetic circuit.

An evacuated betatron tube, in which the electrons to be accelerated circulate, is arranged between the front sides of the two inner yoke parts. The front sides of the inner yoke parts are formed in such a way that the magnetic field produced by the main field coil forces the electrons into a circular orbit and moreover focuses them onto the plane in which this orbit lies. To control the magnetic flux, it is prior in the art to arrange a ferromagnetic insert between the front sides of the inner yoke parts within the betatron tube.

SUMMARY OF THE INVENTION

To protect the surrounding area from x-radiation, betatrons are provided with lead shielding, which allows radiation to leave only at a defined place. As a result, it is therefore an object of the present invention to design a lead shielding in such a way that the heat produced in the betatron is dissipated.

Within the scope of this document, the term lateral surface designates the curved surface of a half cylinder. The opposing flat area is designated as the cut face.

The lead shielding of the invention for a betatron includes at least four shielding parts, of which two parts are formed in the shape of half cylinders and are provided with recesses in their lateral surfaces, whereby the half-cylinder-shaped shielding parts with their lateral surfaces are arranged in the corresponding recesses of the other shielding parts, so that the recesses in the lateral surfaces form air passages between the half-cylinder-shaped shielding parts and the other shielding parts.

This arrangement has the advantage that any complicated flow channels can be produced by the introduction of suitable recesses in the lateral surfaces of the half-cylinder-shaped shielding parts. The arcuate contact surfaces between the half-cylinder-shaped shielding parts and the other shielding parts cause an effective air flow without an abrupt change in direction, which would result in stoppage of the air. The x-radiation is effectively shielded by the curved lateral surface as a boundary of the air passage and the possibility of designing the air passage as curves, because there is no direct line of sight between the betatron and the surrounding area.

In an embodiment of the invention, the two half-cylinder-shaped shielding parts can be designed and arranged rotationally symmetric to one another in regard to their cross section. This means that the air flowing into the shielding along a lateral surface must reach the diagonally opposite edge of the second half cylinder in order to flow out again. This has the result that the air flows through the entire interior space of the lead shielding.

At least two of the other shielding parts have air passages, which connect the recesses in the lateral surfaces of the half-cylinder-shaped shielding parts with the surrounding area. Air flows from the surrounding area through these air passages into the interior of the shielding or out again.

In an embodiment of the invention, the half-cylinder-shaped shielding parts can lie with their cut surfaces on the opposing front sides of the outer yoke of the betatron. This assures that the air is guided past the main field coils, the betatron tube, and the inner yoke and does not flow through between the half-cylinder-shaped shielding parts and the outer yoke. In this case, the cut surfaces of the half-cylinder-shaped shielding parts are preferably at least as large as the front sides of the outer yoke. This achieves that the inflowing air is not obstructed by the front side of the outer yoke and a congestion pressure that reduces the cooling efficiency does not develop.

The lead shielding of the invention is advantageously used with a betatron in an x-ray inspection system for security inspection of objects. Electrons are injected into the betatron and accelerated, before they are guided to a target having, for example, tantalum. There, the electrons produce x-radiation with a known spectrum. The x-radiation is directed onto the object, preferably a container and/or a motor vehicle, and there modified, for example, by scattering or transmission attenuation. The modified x-radiation is measured by an x-ray detector and analyzed by means of an evaluation unit. A conclusion on the nature or the content of the object can be reached from the result.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
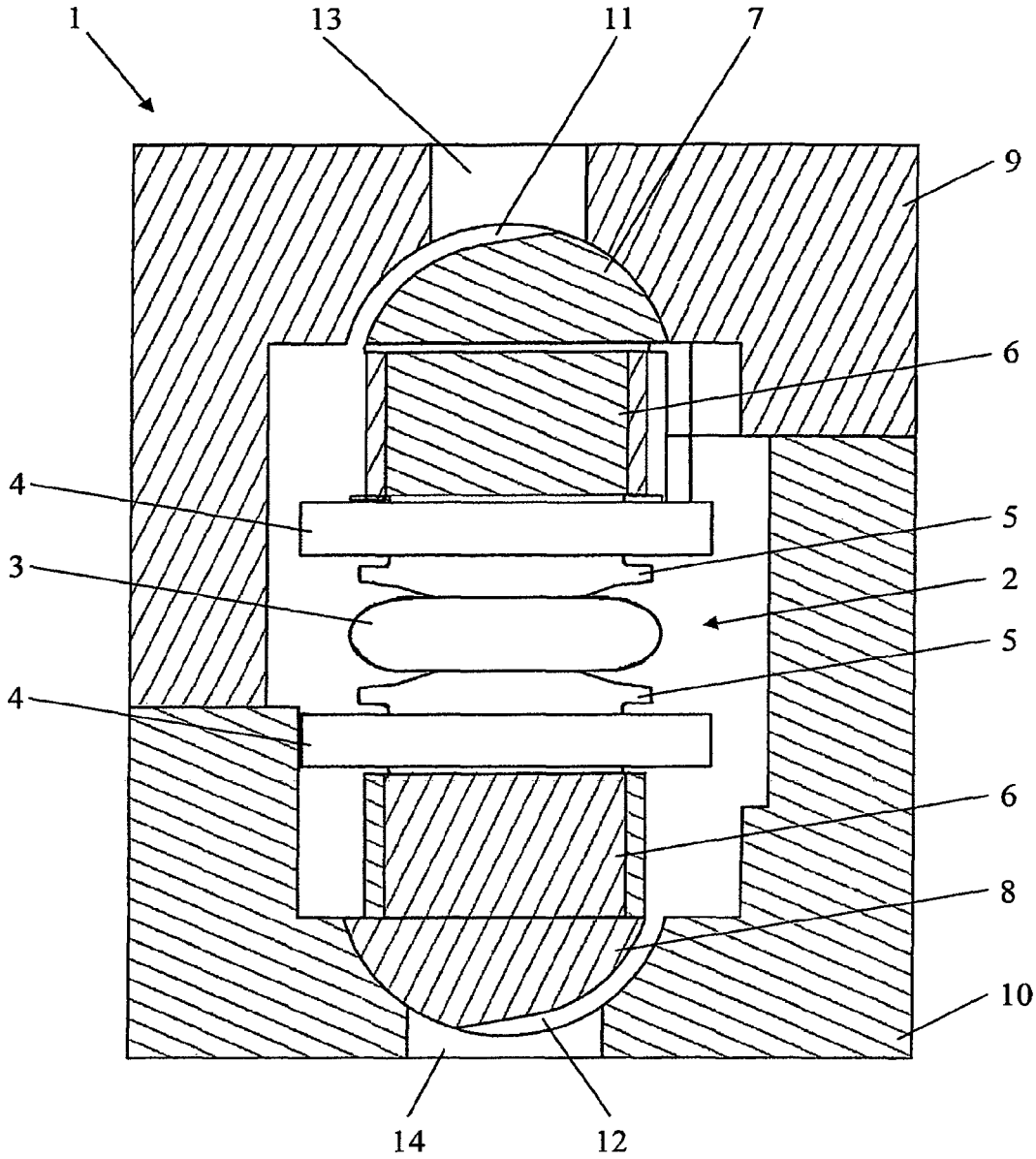
FIG. 1 shows a schematic sectional view through the lead shielding of the invention.

FIG. 1 shows a schematic sectional view of lead shielding 1 of the invention with a betatron 2 arranged therein. Betatron 2 includes a betatron tube 3, main field coils 4, an inner yoke 5, and an outer yoke 6, but may have any other structure.

Lead shielding 1 includes two half-cylinder-shaped shielding parts 7 and 8 and two other shielding parts 9 and 10. Recesses 11 or 12 are introduced in the lateral surfaces of the half-cylinder-shaped shielding parts 7 and 8. The half-cylinder-shaped shielding part 7 lies in a recess of shielding part 9 in such a way that recess 11 in its lateral surface forms an air passage between shielding parts 7 and 9. Similarly, recess 12 in the lateral surface of the half-cylinder-shaped shielding part 8 forms an air passage between shielding parts 8 and 10. Air passages in the form of recesses 13 and 14 in shielding parts 9 and 10 connect recesses 11 or 12 with the surrounding area of lead shielding 1.

Figure 2:
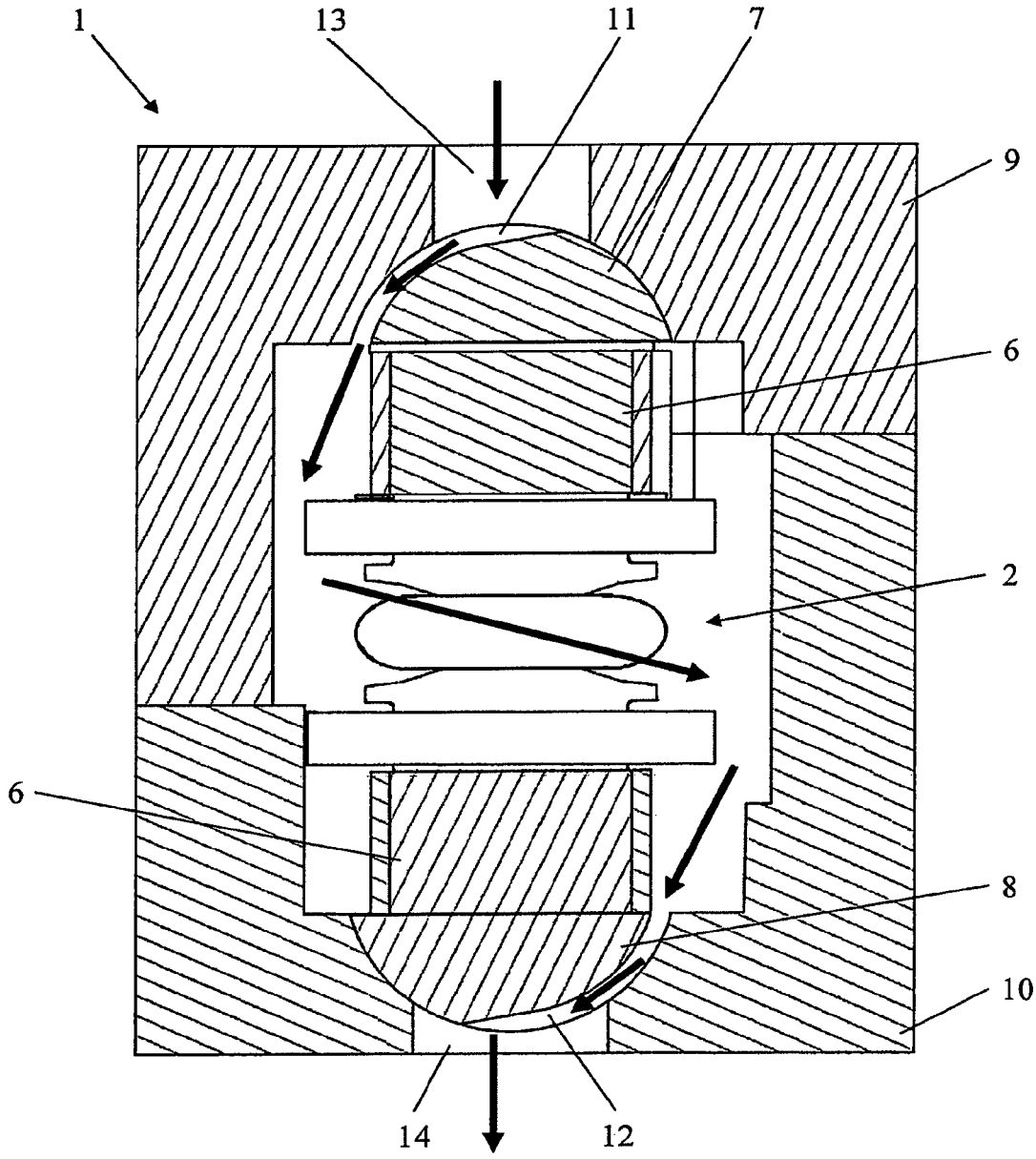
FIG. 2 shows the illustration from FIG. 1 with an indicated air flow.

Lead shielding 1 is designed in such a way that the cut surfaces of the half-cylinder-shaped shielding parts 7 and 8 lie on the opposing, rectangular front sides of outer yoke 6. In the sectional view in FIG. 1, recesses 11 and 12 in the lateral surfaces of the half-cylinder-shaped shielding parts 7 or 8 are formed and arranged rotationally symmetric to one another. This results in the air flow configuration, indicated by the arrow in FIG. 2, through lead shielding 1. The air reaches the left upper corner of the interior space of lead shielding 1 through recesses 13 and 11. Because the air outlet in the form of recesses 12 and 14 is located in the right lower corner, the air flows diagonally through the interior space of lead shielding 1 past betatron tube 3, main field coils 4, and inner yoke 5 and in this way dissipates the heat arising in betatron 2. Optionally, the air is blown in, for example, by ventilators or fans into recess 13 and/or drawn out of recess 14.

Figure 3:
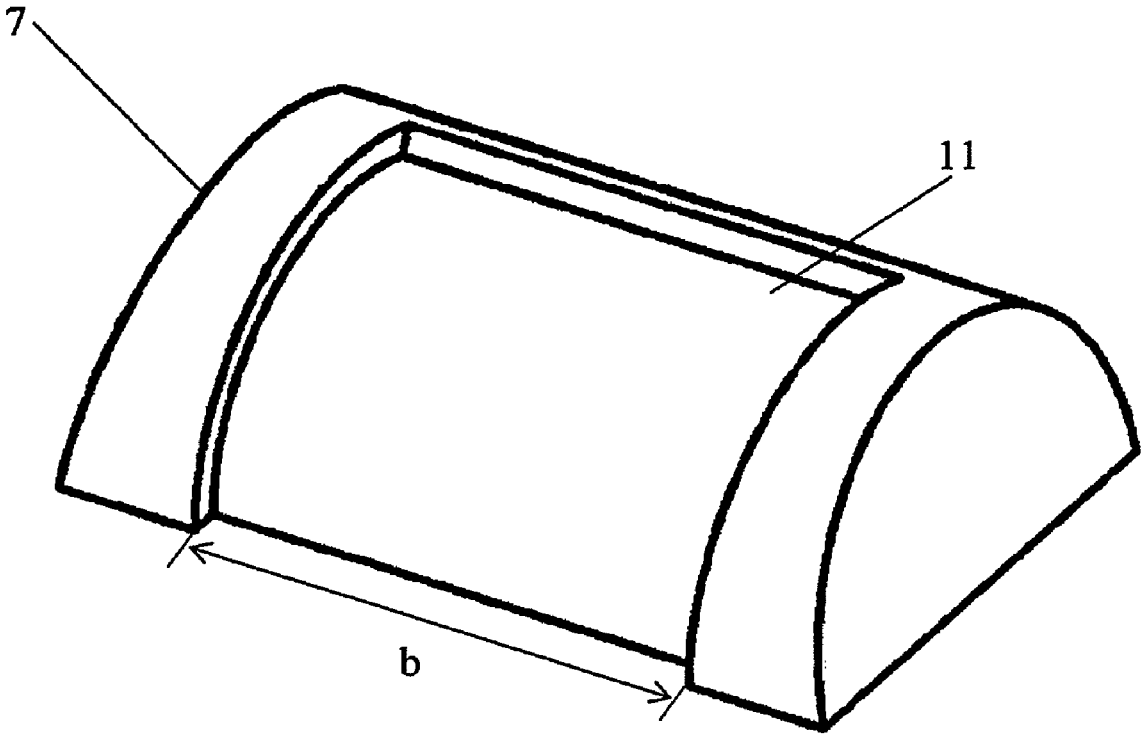
FIG. 3 shows a spatial view of a half-cylinder-shaped shielding part.
Figure 4:
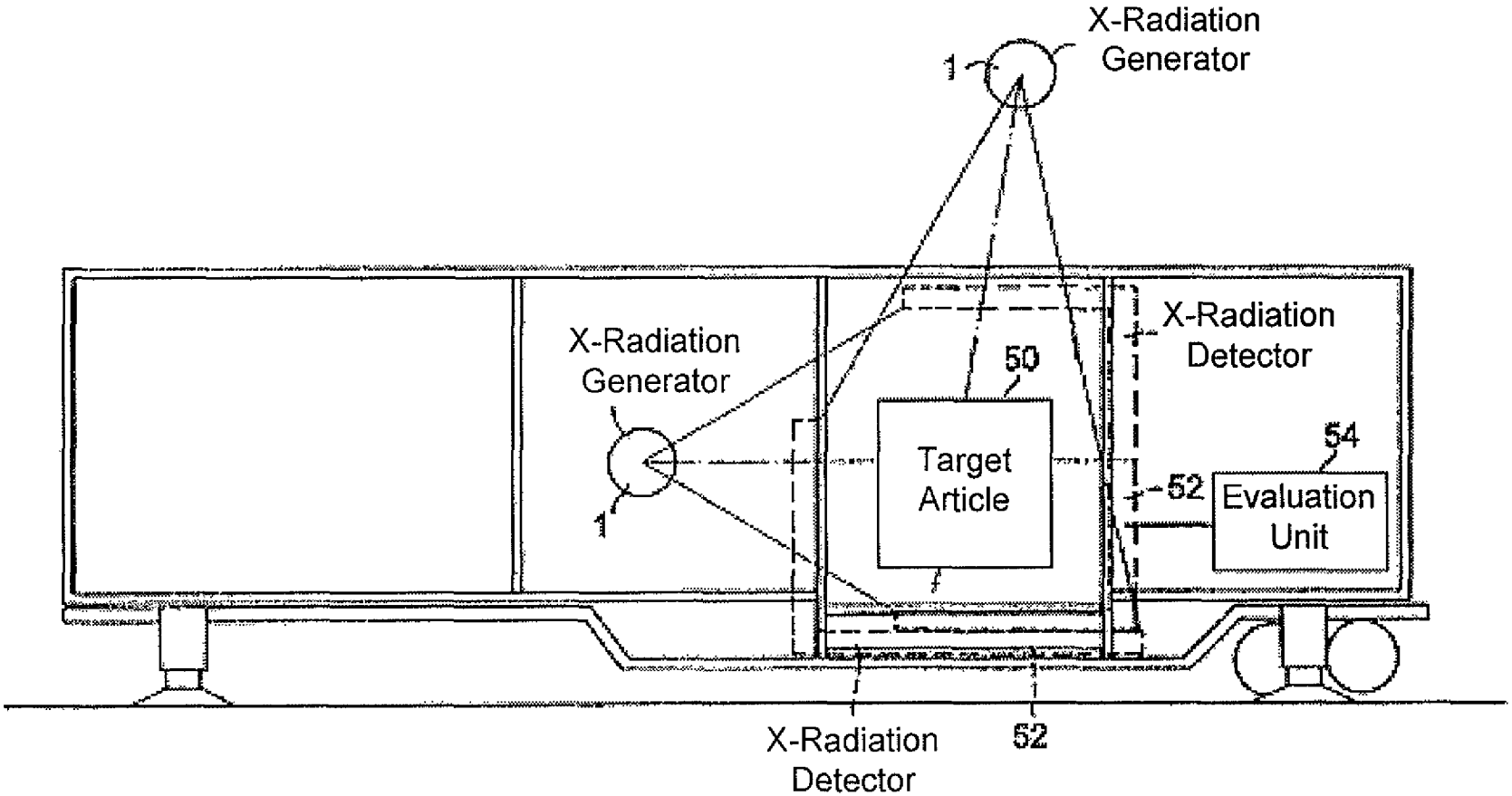
Fig. 4 (Conventional Art)
FIG. 4 shows a conventional x-ray inspection system for security inspection of objects.

FIG. 3 shows a spatial view of half-cylinder-shaped shielding part 7. The width b of recess 11 corresponds to the dimension of the front side of outer yoke 6 along an axis perpendicular to the plane of the drawing of FIGS. 1 and 2. Optionally, recess 11 extends over the entire height of half-cylinder-shaped shielding part 7. Preferably, the dimension of recess 13 along the axis perpendicular to the drawing plane of FIG. 1 or 2 corresponds to the width of recess 11 in the lateral surface of half-cylinder-shaped shielding part 7 in FIG. 3. The aforementioned designs apply analogously to the half-cylinder-shaped shielding part 8 and recesses 12 and 14.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A lead shielding for a betatron in an x-ray generator, the lead shielding comprising:

at least four shielding parts, of which two shielding parts are formed in a shape of half cylinders in order to form half-cylinder-shaped shielding parts and are provided with recesses in lateral surfaces of the half-cylinder-shaped shielding parts, the half-cylinder-shaped shielding parts with recesses in their lateral surfaces being arranged in corresponding recesses of the other shielding parts so that the recesses in the lateral surfaces form air passages between the half-cylinder-shaped shielding parts and the other shielding parts, wherein the at least four shielding parts are adapted to block x-radiation generated from the betatron.

2. The lead shielding according to claim 1, wherein the half-cylinder-shaped shielding parts are formed and arranged rotationally symmetric to one another with respect to their cross section.

3. The lead shielding according to claim 1, further comprising air passages in at least two of the other shielding parts, the air passages configured to connect the recesses in the lateral surfaces of the half-cylinder-shaped shielding parts with the surrounding area.

4. A lead shielding for a betatron in an x-ray generator, the lead shielding comprising:

at least four shielding parts made of lead, of which two shielding parts are formed in a shape of half cylinders in order to form half-cylinder-shaped shielding parts and are provided with recesses in lateral surfaces of the half-cylinder-shaped shielding parts, the half-cylinder-shaped shielding parts with recesses in their lateral surfaces being arranged in corresponding recesses of the other shielding parts so that the recesses in the lateral surfaces form air passages between the half-cylinder-shaped shielding parts and the other shielding parts, wherein the half-cylinder-shaped shielding parts lie with their cut surfaces on opposing front sides of an outer yoke of the betatron.

5. The lead shielding according to claim 4, wherein the cut surfaces of the half-cylinder-shaped shielding parts are at least as large as the front sides of the outer yoke.

6. An x-ray inspection system for security inspection of objects, comprising:

a target to produce x-radiation;

an x-ray detector;

an evaluation unit; and a betatron with lead shielding, the lead shielding comprising at least four shielding parts, of which two parts are formed in a shape of half cylinders and are provided with recesses in their lateral surfaces, the half-cylinder-shaped shielding parts with their lateral surfaces being arranged in corresponding recesses of the other shielding parts so that the recesses in the lateral surfaces form air passages between the half-cylinder-shaped shielding parts and the other shielding parts.

* * * * *